United States Patent [19]

Nalbandian et al.

[11] 4,283,757

[45] Aug. 11, 1981

[54] ILLUMINATED SCREWDRIVER

[75] Inventors: A. Eugene Nalbandian, Brea; James P. Sullivan, Tustin, both of Calif.

[73] Assignee: Tweezer-Lite, Inc., Brea, Calif.

[21] Appl. No.: 56,280

[22] Filed: Jul. 9, 1979

[51] Int. Cl.[3] ..... B25B 23/18

[52] U.S. Cl. ..... 362/120; 362/119; 362/251

[58] Field of Search ..... 362/120, 119, 251

[56] References Cited

U.S. PATENT DOCUMENTS

| | | | |
|---|---|---|---|
| 2,525,414 | 10/1950 | Kleinschmidt | 362/120 |
| 3,185,832 | 5/1965 | Nagamori | 362/120 |
| 4,107,765 | 8/1978 | Singleton | 362/120 |

*Primary Examiner*—Stephen J. Lechert, Jr.

*Attorney, Agent, or Firm*—Spensley, Horn, Jubas & Lubitz

[57] ABSTRACT

Disclosed herein is an illuminated screw driver or hand tool. The hand tool has a hollow handle body within which is disposed at least one light bulb, one power source and a spring for biasing the light bulb and the power source out of contact with one another. Rotation of an end cap switch moves the power source towards contact with the light bulb thereby completing the circuit and lighting the bulb. Alternate embodiments illustrate illuminated screwdrivers having one, two or three such light bulbs and power sources and spring means for biasing each bulb and power source out of contact with one another. In the embodiment having three light bulbs there is provided a mechanism for selectively turning on one, two or all three of the light bulbs.

15 Claims, 11 Drawing Figures

10
11
26
30
31
32
34
36
38
39
40
20
21
22
24
42
80
82
83
84
85
86
88
90
92
93
94
96
98
100

ILLUMINATED SCREWDRIVER

BACKGROUND OF THE INVENTION

1. Field of the Invention

This invention relates to the construction of battery powered illuminated hand tools and specifically to the mechanism for applying power to the light source thereof.

2. Prior Art

Illuminated tools, such as a screwdriver, have long been available. Various such tools are shown in the U.S. patents, for example: U.S. Pat. Nos. 1,635,933 to Genoves; 2,242,536 to Montgomery; 2,408,601 to Blauvelt; 2,736,792 to Freeland; 3,185,832 to Nagamori; 2,670,427 to Barlet et al. These patents illustrate various structures designed to provide light at the end of the tool. They also illustrate various mechanisms for applying and removing power from the light bulb.

Typically a light bulb is provided with a threaded base portion, the threads of which define one terminal of the bulb. The base also has a protrusion from its end defining the other terminal of the bulb. A power source, such as a battery, has one terminal held against a terminal of the bulb by a spring. The other (distant) terminal of the battery is connected to the threaded terminal of the bulb by a discontinuous electrical path which is generally made continuous by moving a slide switch. Such a mechanism is shown in the U.S. patents to Blauvelt, Freeland and Nagamori.

Other methods for closing the discontinuous electrical path from the bulb to the far terminal of the power source include the use of a metal screw mounted to the base of the handle of the tool. When the screw is rotated, it advances toward and contacts the terminal of the power source completing the electrical circuit. Such are the devices of Genoves (U.S. Pat. No. 1,635,933) and Barlet et al. (U.S. Pat. No. 2,670,427).

Another mechanism is shown in Montgomery (U.S. Pat. No. 2,242,536) where contact with the far terminal of the battery is made by a spring 24 connected to a strip 23 which may be rotated to make or break connection with a strip 25 connected to the light bulb.

SUMMARY OF THE INVENTION

An illuminated hand tool is provided with a hollow handle body within which is disposed a light bulb and a power source spring biased out of contact with one another. Rotation of an end cap switch moves the power source toward contact with the light bulb and completion of the circuit thus lighting the bulb. Alternate embodiments illustrate illuminated screwdrivers having two or three such light bulbs and power sources spring biased out of contact. In the embodiment having three light bulbs, means are provided to light one, two or all three light bulbs.

DETAILED DESCRIPTION OF THE PREFERRED EMBODIMENT

Figures 1, 7, 8, 9, 9A:
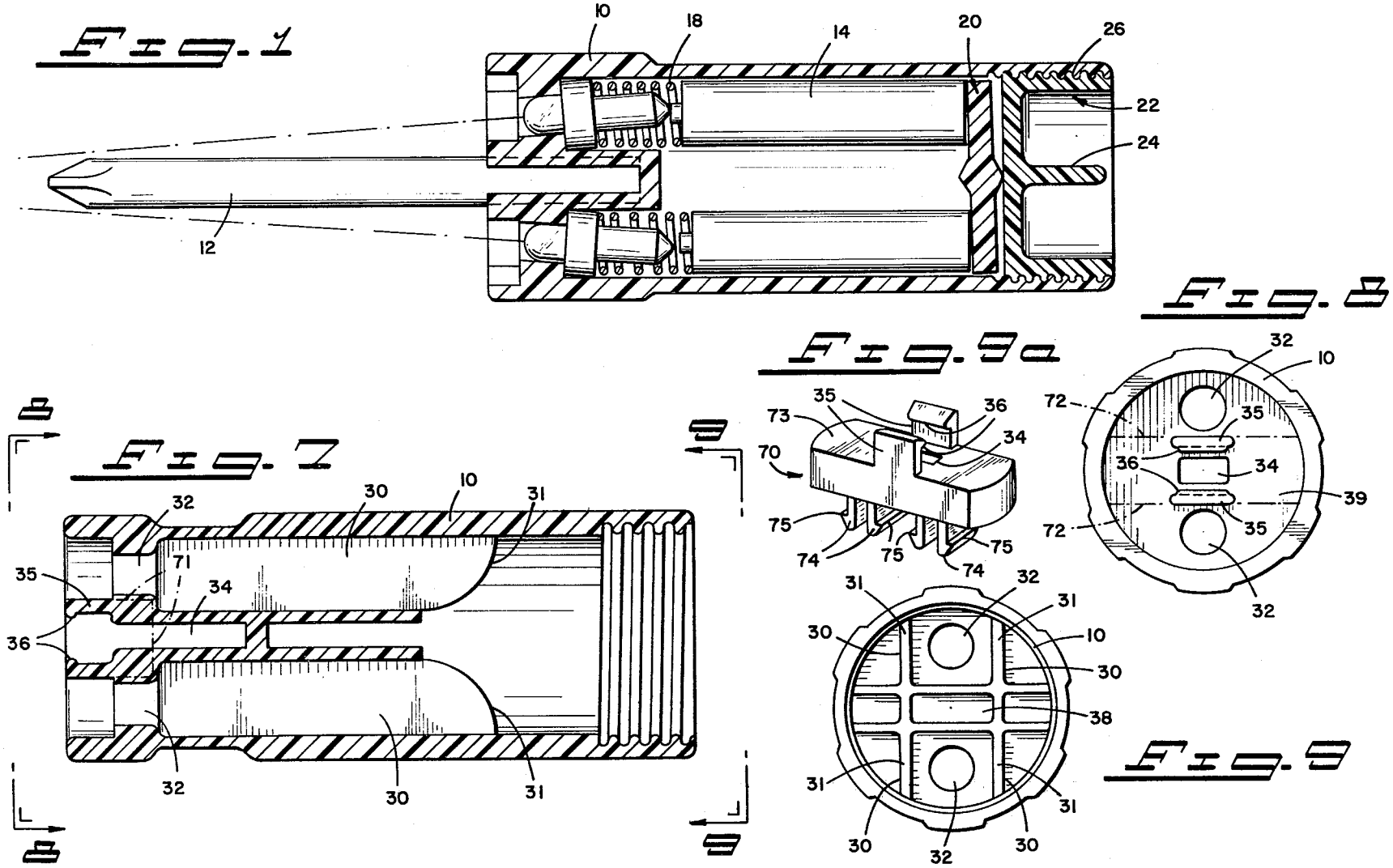
FIG. 1 is a partial cutaway showing the internal structure of the handle of the tool.
FIG. 7 is a sectional view along a diameter of a two light source embodiment of the tool handle.
FIG. 8 is a front end view of the handle body of FIG. 7.
FIG. 9 is a back end view of the handle body of FIG. 7.
FIG. 9*a* is a perspective view of an alternate embodiment of the construction of the members illustrated most clearly in FIG. 8.

An illuminated hand tool using the mechanism of the present invention is shown in FIG. 1. A housing 10 comprising the handle body of the tool has textured portions 11 to facilitate gripping of the handle. The housing is generally hollow but is provided with a structure at its forward end for supporting at least one tool blade 12 centrally therein. The tool blade may advantageously be a screwdriver blade. Disposed within the hollow housing 10 are a battery 14 or other suitable source of power, a bulb 16 or other light source, and a spring 18 disposed between the bulb and the battery so as to bias the bulb and battery out of contact with one another. At the rearward end of the housing 10 there is a cap 22 separated from the battery by a washer 20. The cap is provided with a gripping means such as the ridge 24 and is threadably engaged with the rearward end of the housing 10 by means of threads 26. Rotation of the cap member 22 applies pressure and motion to the washer 20 which in turn causes the battery to move against the bias of the spring 18 toward the bulb 16 causing the bulb to contact the battery thereby completing the circuit and lighting the bulb.

Figures 2, 3, 4, 5, 6, 7, 8, 9, 10:
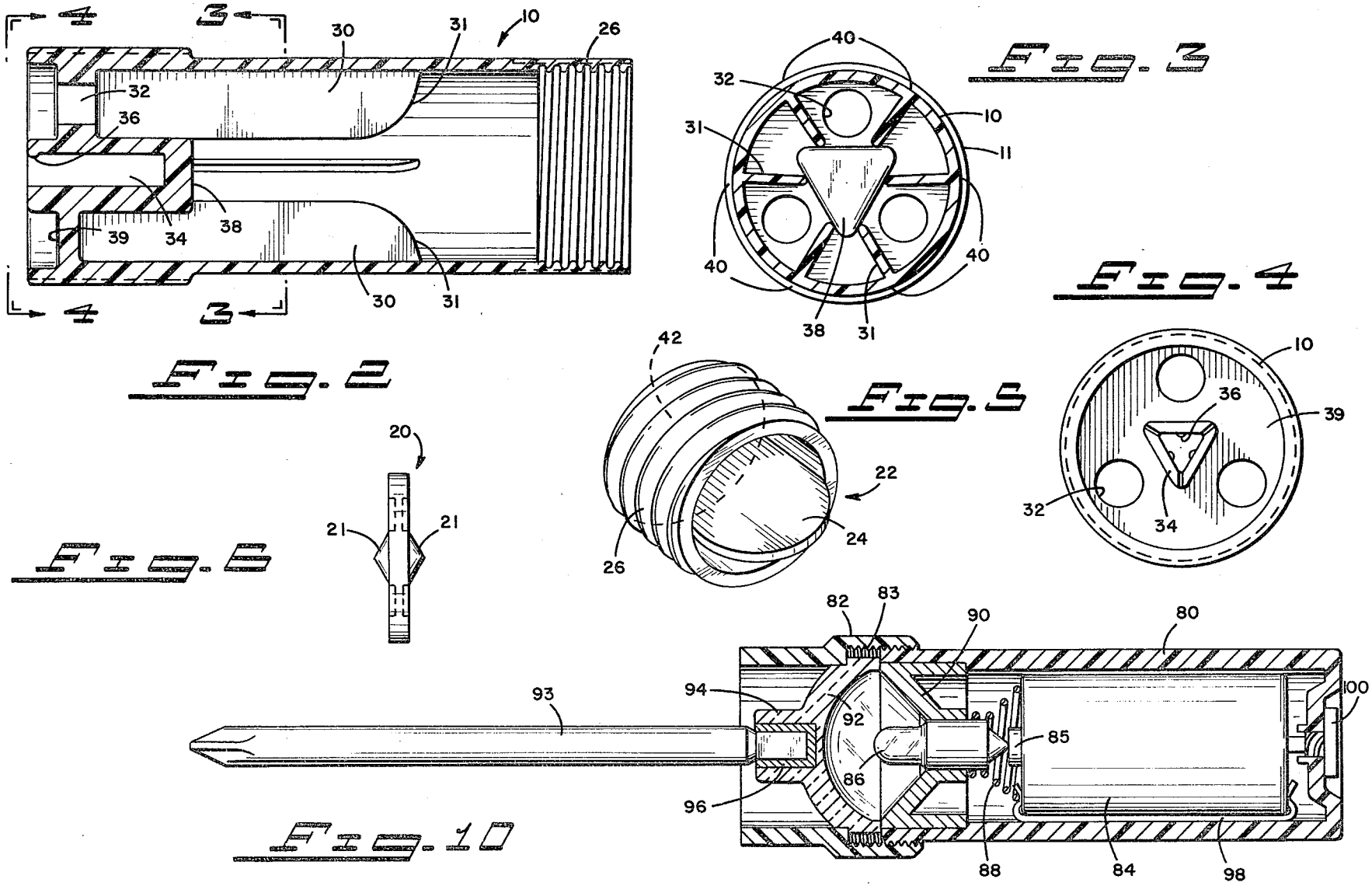
FIG. 2 is a sectional view along a diameter of the handle.
FIG. 3 is a sectional view taken along the line 3—3 of FIG. 2.
FIG. 4 is an end view of the handle taken in the direction indicated by the line 4—4 of FIG. 2.
FIG. 5 is a perspective view of the rotatable end cap of the handle.
FIG. 6 is an edge view of a washer member used in the present invention and showing particularly the axial protrusions of the washer.
FIG. 10 is a cutaway of the single light bulb embodiment of the invention.

The structure of the housing 10 is more fully illustrated in FIG. 2. The bulb 16, the spring 18, and the washer 20 and cap 22 have been removed from the housing 10 so that the internal details or structure of the housing are more readily apparent. FIG. 2 thus shows the internal threads 26 at the rear end of the housing which serve to mesh with the threads on the cap 22. Fin-like partition members 30 are provided to divide the internal volume of the housing 10 into compartments for receiving the battery 14. The rearward end of these fins 30 are provided with an arcuate portion 31 to facilitate insertion of the battery (or batteries) into the compartment (or compartments). The forward end of the housing 10 is provided with one or more apertures 32 so as to allow the light from the bulb 16 to pass out of the housing and illuminate the end of the tool blade 12. The tool blade is inserted into the seat 34 provided at the center of the forward end of the housing 10. The seat is provided with protrusions 36 which serve to interlock with indentations provided on the tool blade 12 and thereby secure the blade in the seat. The seat is provided with a rearward wall 38 which has a generally triangular shape as shown more clearly in FIG. 3. The aperture 32 and the seat 34 are formed in the structure of the forward wall 39 which closes the forward end of the housing 10. The fins 30 extend from the wall of the housing radially inward toward and in contact with the outer wall of the seat 34 thereby lending rigidity to the seat 34. This structural cooperation can be clearly seen in FIG. 3.

For that particular embodiment of the present invention which employs three light sources, there are provided six fins 30 as shown in FIG. 3. These fins are located radially so as to define compartments for the bulbs, springs and batteries housed within the housing 10. As shown in FIG. 3 each battery compartment occupies 70 degrees of arc and is separated from the adjacent battery compartment by approximately 50 degrees of arc. This provides for three battery compartments with 50 degrees of space between each compartment.

FIG. 4 shows a forward end view of the housing 10 and illustrates the preferred triangular shape of the seat 34 used to secure the tool blade 12 within the handle portion of the housing 10. Also illustrated in FIG. 4 are the three protrusions 36 which interlock with recesses on the tool blade shank to snap-lock the tool blade within the seat 34. As shown in FIG. 4 the bulb apertures 32 are equally spaced from one another by approximately 120 degrees thereby providing for equal lighting in all directions of the tool blade 12.

The perspective view of the end cap 22 (FIG. 5) shows its external threads 26 and the gripping means which constitutes a ridge or wall 24 which extends along a diameter of the cap and serves as a means for defining finger recesses for gripping the cap so that it may be rotated. The bottom of the end cap designated 42 in the Figure, presents a flat surface on the side of the end cap opposite the grip 24. This flat end surface 42, upon rotation of the end cap 22, contacts the washer 20 and thereby applies force to the power source or battery 14 causing it to move toward the bulb 16.

In the particular embodiment of the present invention which utilizes three bulbs, three springs and three batteries, the particular features of the washer 20, as illustrated in detail in FIG. 6, are significant. As shown in FIG. 6 the washer 20 is provided with at least one and perhaps two protrusions 21 located at the center of the washer and projecting axially outward from the plane of the washer. The protrusion 21 preferably does not terminate in a flat surface, but rather in a generally pointed or curved surface having a small radius of curvature that functions as a pivot point. When such a washer is used in the embodiment of the present invention having three light bulbs, batteries and springs, a unique interaction of the assembly permits the three light bulbs to be turned on serially in a manner which provides for the lighting of a single light bulb, for the lighting of two light bulbs, or for the lighting of three light bulbs. When such a washer is used the rotation of the end cap 22 applies a force to the protruding end of the protrusion 21 thus applying that force to the center of the washer. Because the force is applied to the center, the slightest spring bias unbalance in the assembly will cause the washer to become slightly skewed and apply the force unequally to the three power sources or batteries 14. The batteries 14 thus will move toward their respective bulbs at different times. Thus, a slight advance of the cap 22 will cause the weakest spring to compress and allow its respective battery to contact its respective bulb and turn on that bulb. A further rotational advance of the cap 22 will cause the second weakest spring to compress and allow its respective battery 14 to contact its bulb and turn it on thus lighting two bulbs. The greatest advance of the cap 22 will cause the strongest spring to compress and allow the final battery 14 to contact its respective bulb and thus all three light bulbs will be lighted. This feature permits the user of the embodiment of the present invention having three light bulbs to adjust the amount of light which is used to illuminate the tool blade 12 according to the illumination present at the work site. Simply by rotating the cap 22 the user may provide for the illumination equal to one, two or three light bulbs.

An embodiment of the invention as adapted for use in a screwdriver handle having two light bulbs, two biasing springs and two power sources is illustrated in FIGS. 7 through 9. The various parts of this handle which correspond to equivalent parts of the three light embodiment have been given the same reference numerals.

A portion of the internal volume of housing 10 is divided into two battery compartments by fins 30 which are optionally provided with a curved end 31. The battery compartments are formed to be colinear with the apertures 32 which allow the light from the bulbs (not shown) to illuminate the tool. The tool is shaped for seating within the generally rectangular seat 34 and is provided with slight depressions on its external shank surface for snap-lock engagement with the detent keys 36 supported on the two opposed protrusions 35 extending longitudinally from the open end of the seat 34.

A view of the forward end of the handle shows the housing 10 and the placement of the two apertures 32 approximately 180 degrees from each other. The generally rectangular seat 34 is flanked by the two protrusions 35 having detent keys 36 for snap-lock engagement with the tool. The seat 34, protrusions 35 and apertures 32 are formed in the forward wall structural member 39.

The back end view of the handle with the cap 22 removed, as illustrated in FIG. 9, makes clear the location of the fins 30 and the connecting web structure which lends rigidity to the seat 34 and the housing 10. FIG. 9 also shows the rear end wall 38 of the seat 34 and the relative position of the apertures 32.

While the protrusions 35 and detent keys 36 as well as the seat 34 are shown to be integrally constructed with the handle housing 10, these parts may alternately be formed as an insert unit 70 shown in FIG. 9*a*. The advantage in making the protrusions 35, detent keys 36, and seat 34 in the form of an insert member is one of cost. The detent keys have greater flexibility if made of DELRIN, however DELRIN is more expensive than the ABS plastic used to form the housing 10. Thus the housing may be made of cheaper ABS plastic and the protrusions and detent keys made of flexible and more expensive DELRIN without unduly raising the cost of the device as a whole.

The insert member 70 comprises the base portion 73, the bottom surface of which is provided with two pairs of depending protrusions 74, each of which is provided with an appropriately oriented detent key 75. The upper surface of the base 73 is provided with a pair of protrusions 35 having detent keys 36 for snap-locking a tool member in place within seat 34 which extends at least part way through the thickness of base portion 73.

The placement of the insert member 70 is illustrated by phantom line 71 in FIG. 7 and phantom lines 72 in FIG. 8. Insert member 70 is snap-locked into place in housing 10 by means of the two pairs of protrusions 74 having opposite and outwardly directed detent keys 75 which snap insert member 70 onto housing 10 in much the same way that a tool blade would be snap-locked onto insert member 70.

An alternate embodiment of the present invention is illustrated in FIG. 10 wherein a single light bulb, spring, and battery are housed within the housing 80 and generally located along the axial centerline of the housing. The tool of FIG. 10 has a housing 80 and a retainer cap 82 threadedly engaged over the forward end of the housing 80. The tightening of this threaded engagement between the retainer cap 82 and the housing 80 secures therebetween a lens element 92 which is provided with a seat 94 for securing therein a tool blade 93. A metal insert 96 may be provided within the seat 94 such as by integral molding with the lens to further secure the joint between the tool blade 93 and the lens 92. The lens 92 comprises substantially transparent plastic. Housed longitudinally within the housing 80 are the bulb 86 and a battery 84 which are spring biased out of contact with one another by means of a coil spring 88 disposed between the bulb 86 and the battery 84. The light from the bulb 86 is focused by a reflector 90 and directed through the lens 92 and onto the working end of the tool blade 93.

As can be seen from FIG. 10, the battery 84 has a first terminal at one end of the battery and a second terminal at the other end of the battery. A metal contact strip 98 extends from one end of the battery around to the other end of the battery which has the central terminal designated 85 in FIG. 10. The metal contact strip 98 provides a point of contact between the rearward end of the battery 84 and the spring 88. The battery 84 is moved toward the bulb 86 by means of the cam switch 100 which is essentially a screw member having very steep pitched threads. Rotation of the cam switch 100 advances the cam switch toward the battery 84 which in turn moves the battery compressing the spring 88 until the central terminal 85 of the battery contacts the bulb 86 thus completing the electrical circuit and lighting the bulb.

There has thus been described and provided a unique mechanism for closing an electrical circuit thereby lighting the bulb in an illuminated tool such as a screwdriver as disclosed in the various embodiments herein. While the various embodiments have been described with reference to the FIGS. 1 through 10, the alternative embodiments are not to be interpreted as limitations upon the present invention. Many changes and modifications may be made by one skilled in the art to the various embodiments disclosed herein without departing from the spirit and scope of the present invention. It is intended that the invention be limited only by the scope of the appended claims.

We claim:

1. An illuminated hand tool comprising a tool member mounted at the front end of a hollow handle body in which are disposed a pair of two terminal light sources, a pair of spring members having a first end and a second end, and a pair of two terminal power sources;

each of said spring members being disposed between a respective light source and power source, the first end of each spring contacting one terminal of its respective light source, the second end of each spring being in electrical contact with one terminal of its respective power source, each said spring acting to bias the other terminal of each respective light source out of contact with the other terminal of each respective power source;

a single switch means rotatably mounted on the back end of said body for causing movement of said power sources upon rotation of said switch means so as to cause the other terminal of each respective power source to independently contact the other terminal of each respective light source thereby completing the respective circuits and lighting the respective light sources either serially or simultaneously.

2. The device according to claim 1 wherein each respective light source, spring and power source is mounted off the longitudinal centerline of said handle body and spaced approximately 180 degrees from the other of said pair of light sources, spring and power sources.

3. The device according to claim 2 wherein each said light source is a light bulb, each said spring is an electrically conductive coil spring and each said power source is a battery.

4. The device according to claim 3 wherein said rotatable switch means comprises:

a cap member threadingly mounted to the other end of said handle body; and a washer member;

said washer member being disposed between said cap and said power sources whereby rotation of said cap advances said washer against said power sources which thereby moved against said spring bias to contact said light source.

5. The device of claim 1 wherein said hand tool is a screwdriver.

6. An illuminated hand tool member comprising a tool blade mounted at the front end of a hollow handle body in which are disposed three light sources each having a first terminal and a second terminal, three spring members each having a first end and a second end, and three power sources each having a first and a second terminal;

each of said spring members being disposed between a respective light source and power source, the first end of each spring contacting one terminal of its respective light source, the second end of each spring being in electrical contact with one terminal of its respective power source, each said spring acting to bias the other terminal of each respective light source out of contact with the other terminal of each respective power source;

a single switch means rotatably mounted on said body for causing movement of said power sources upon rotation of said switch means so as to cause the other terminal of each respective power source to independently contact the other terminal of each respective light source thereby completing each respective circuit and lighting the respective light sources either serially or simultaneously.

7. The device according to claim 6 wherein each respective light source, spring and power source is mounted off the longitudinal centerline of said handle body and spaced approximately 120 degrees from the others.

8. The device according to claim 7 wherein each said light source is a light bulb, each said spring is an electrically conductive coil spring and each said power source is a battery.

9. The device according to claim 6 wherein said switch means comprises a cap member threadingly mounted at the other end of said handle body and a washer member, said washer member being disposed between said cap and said power sources whereby rotation of said cap advances said washer against said power sources which are thereby moved against their respective spring biases to contact their respective light sources.

10. The device according to claim 9 wherein said washer is provided with an axial protrusion extending between said washer and said cap whereby rotation of said cap advances said cap against said protrusion advancing each power source against its respective spring;

each respective spring being of slightly different strength;

whereby rotation of said cap first causes the spring of weakest strength to compress sufficiently to allow its respective power source to contact its respective light source thereby turning on that light source;

further rotation of said cap causing the next strongest spring to compress sufficiently to allow its respective power source to contact its respective light source thereby turning on that light source in addition; and further rotation of said cap causing the strongest spring to compress sufficiently to allow its respective power source to contact respective light source thereby turning on that light source such that all three light sources are turned on.

11. The device of claim 10 wherein said hollow handle body is provided with a plurality of radially inwardly projecting fins defining compartments for the power sources.

12. In an illuminated hand tool comprising a hollow handle body, a tool blade mounted at one end of said body and a plurality of light bulbs and respective batteries, the improvement comprising:

a plurality of springs, each of slightly different strength, each such spring being disposed between a light bulb and its respective battery so as to bias the light bulb out of contact with its respective battery;

a cap member threadingly mounted at the other end of said handle body; and a washer member disposed between said cap member and said plurality of batteries and provided with an axial protrusion extending between said washer and said cap member, said protrusion functioning as a pivot;

whereby rotation of said cap member advances said cap against the protrusion of said washer which in turn advances said batteries against their respective bias springs to sequentially contact their respective light bulbs.

13. An illuminated hand tool according to claim 1 wherein said tool member is mounted upon an insert member:

said insert member comprising a base portion provided with a recessed seat thereon, said seat being flanked by a pair of protrusions which have detent keys for securing said tool member by means of a snap-lock within said seat, said insert member being adapted to itself be secured to said handle body by a snap-lock fit.

14. The device according to claim 4 wherein said washer is provided with an axial protrusion extending between said washer and said cap whereby rotation of said cap advances said cap against said protrusion advancing each power source against its respective spring;

each respective spring being of slightly different strength;

whereby rotation of said cap first causes the spring of weaker strength to compress sufficiently to allow its respective power source to contact its respective light source thereby turning on that light source; and further rotation of said cap causing the stronger spring to compress sufficiently to allow its respective power source to contact its respective light source thereby turning on that light source such that both light sources are turned on.

15. The device of claim 6 wherein said hand tool is a screwdriver.

* * * * *